US011814889B2

(12) United States Patent
Nagase et al.

(10) Patent No.: US 11,814,889 B2
(45) Date of Patent: Nov. 14, 2023

(54) SYSTEMS AND METHODS FOR OPERATING A POWER TAILGATE SYSTEM

(71) Applicant: Aisin Technical Center of America, Inc., Northville, MI (US)

(72) Inventors: Koji Nagase, Novi, MI (US); Daisuke Yamada, Ann Arbor, MI (US)

(73) Assignee: Aisin Technical Center of America, Inc., Northville, MI (US)

( * ) Notice: Subject to any disclaimer, the term of this patent is extended or adjusted under 35 U.S.C. 154(b) by 458 days.

(21) Appl. No.: 16/832,870

(22) Filed: Mar. 27, 2020

(65) Prior Publication Data

US 2021/0301577 A1 Sep. 30, 2021

(51) Int. Cl.
*E05F 15/611* (2015.01)

(52) U.S. Cl.
CPC ..... *E05F 15/611* (2015.01); *E05Y 2201/408* (2013.01); *E05Y 2400/302* (2013.01); *E05Y 2900/532* (2013.01)

(58) Field of Classification Search
CPC ..... E05F 15/611; E05F 15/60; E05F 15/697; E05F 15/40; E05Y 2900/546; E05Y 2400/532; E05Y 2400/10
See application file for complete search history.

(56) References Cited

U.S. PATENT DOCUMENTS 4,289,995 A * 9/1981 Sorber ..... E05F 15/611 318/369
5,892,340 A 4/1999 Sasajima et al.
9,879,463 B2 * 1/2018 Lombrozo ..... E05B 79/20
9,938,759 B2 * 4/2018 Urase ..... B60J 5/06
10,227,810 B2 * 3/2019 Linden ..... E05B 81/70
2004/0118638 A1 6/2004 Delaporte
2016/0265261 A1 * 9/2016 Urase ..... B60J 5/06
2018/0272845 A1 9/2018 Takenaka et al.
2019/0112849 A1 * 4/2019 Cumbo ..... E05C 17/003
2019/0292818 A1 * 9/2019 Cumbo ..... E05C 17/003
2019/0301231 A1 10/2019 Gabbianelli et al.
2020/0141171 A1 * 5/2020 Ghannam ..... B60Q 1/50
2020/0199930 A1 * 6/2020 Sugiyama ..... H02P 7/29
2020/0378170 A1 * 12/2020 Kerr ..... B60J 5/102
2021/0131160 A1 * 5/2021 Kobayashi ..... E05F 15/622

FOREIGN PATENT DOCUMENTS

JP 2004098913 A 4/2004
JP 2019017196 A 1/2019

* cited by examiner

*Primary Examiner* — Thai T Dinh
(74) *Attorney, Agent, or Firm* — Christopher G. Darrow; DARROW MUSTAFA PC

(57) ABSTRACT

Embodiments of systems and methods for operating a power tailgate system involve a vehicle that includes a tailgate, a motor connected with the tailgate for interdependent movement, and a motor circuit for the motor. The embodiments include, upon the initiation of a driving event in the vehicle, identifying that the tailgate is unclosed. The embodiments further include, in response to identifying that the tailgate is unclosed, upon the initiation of the driving event, irrespective of whether the tailgate is moving or not moving, checking the tailgate against movement during the driving event, wherein checking the tailgate against movement includes operating the motor circuit to electrically brake the motor.

21 Claims, 4 Drawing Sheets

SYSTEMS AND METHODS FOR OPERATING A POWER TAILGATE SYSTEM

TECHNICAL FIELD

The embodiments disclosed herein relate to vehicles with tailgates and, more particularly, to power tailgate systems for automatically opening the tailgates and automatically closing the tailgates.

BACKGROUND

Many vehicles include tailgates. The tailgates serve as closure panels, and are movable between closed positions and open positions. In addition to the tailgates themselves, the vehicles include latch assemblies. Among other things, the latch assemblies include latches for latching the tailgates. To close the tailgates, the latches are activated. When the latches are activated, the latches latch the tailgates as the tailgates are moved to the closed positions, and afterwards, when the tailgates are in the closed positions. To open the tailgates, the latches are deactivated. When the latches are deactivated, the latches unlatch the tailgates as the tailgates are moved to the open positions.

Many of today's vehicles with tailgates also include power tailgate systems. The power tailgate systems include motor-driven tailgate actuators for the tailgates, and motor-driven latch actuators for the latch assemblies. Moreover, the power tailgate systems include specialty hinge assemblies for the tailgates, through which the tailgate actuators are connected with the tailgates. By the operation of the tailgate actuators and the latch actuators, the power tailgate systems automatically open the tailgates and automatically close the tailgates. To automatically open the tailgates, the power tailgate systems open the tailgates after deactivating the latches. To automatically close the tailgates, the power tailgate systems close the tailgates after activating the latches.

Although the power tailgate systems of today's vehicles have proven satisfactory, one contemplated area for improvement concerns vehicles whose tailgates are unclosed during driving events. When the tailgates are in the closed positions, the latches, by latching the tailgates, hold them fast against movement. Contrariwise, when the tailgates are in the open positions, or partially-open positions, the latches, by unlatching the tailgates, no longer hold them fast against movement. If the tailgates are left unchecked against movement, it is contemplated that the movement of the tailgates might become excessive. For instance, when the vehicles drive along rough ground, the movement of the tailgates might become excessive in terms of bouncing. Even when the vehicles drive along normal ground, the movement of the tailgates might become excessive in terms of jolts (e.g., when the vehicles accelerate and decelerate) and vibration (e.g., when the vehicles themselves vibrate). If the movement of the tailgates becomes excessive, the vehicles, and in particular, the power tailgate systems, including but not limited to the tailgate actuators and the hinge assemblies, may suffer the threat of damage.

SUMMARY

Disclosed herein are embodiments of systems and methods for operating a power tailgate system. The embodiments involve a vehicle that includes a tailgate, a motor connected with the tailgate for interdependent movement, and a motor circuit for the motor. In one aspect, the embodiments include, upon the initiation of a driving event in the vehicle, identifying that the tailgate is unclosed. The embodiments further include, in response to identifying that the tailgate is unclosed, upon the initiation of the driving event, irrespective of whether the tailgate is moving or not moving, checking the tailgate against movement during the driving event, wherein checking the tailgate against movement includes operating the motor circuit to electrically brake the motor. This and other aspects will be described in additional detail below.

BRIEF DESCRIPTION OF THE DRAWINGS

The various features, advantages and other uses of the present embodiments will become more apparent by referring to the following detailed description and drawing in which.

DETAILED DESCRIPTION

This disclosure relates to a vehicle that includes a tailgate, and, as part of a power tailgate system, a motor connected with the tailgate for interdependent movement. In relation to the vehicle, this disclosure teaches systems and methods for operating the power tailgate system. According to the systems and methods, when, upon the initiation of driving events, the tailgate is unclosed, the power tailgate system checks the tailgate against movement by electrically braking the motor. In cases of driving events during which, if the tailgate was left unchecked against movement, the movement of the tailgate would have become excessive, the power tailgate system saves the vehicle from suffering the associated threat of damage. The power tailgate system checks the tailgate against movement as a preventative countermeasure against the movement of the tailgate becoming excessive during the driving events. In particular, rather than reacting to the movement of the tailgate, the power tailgate system checks the tailgate against movement upon the initiation of driving events, irrespective of whether the tailgate is moving or not moving. Compared to checking the tailgate against movement as a corrective countermeasure against the movement of the tailgate becoming excessive, the power tailgate system eliminates issues concerning reaction time.

Figure 1A:
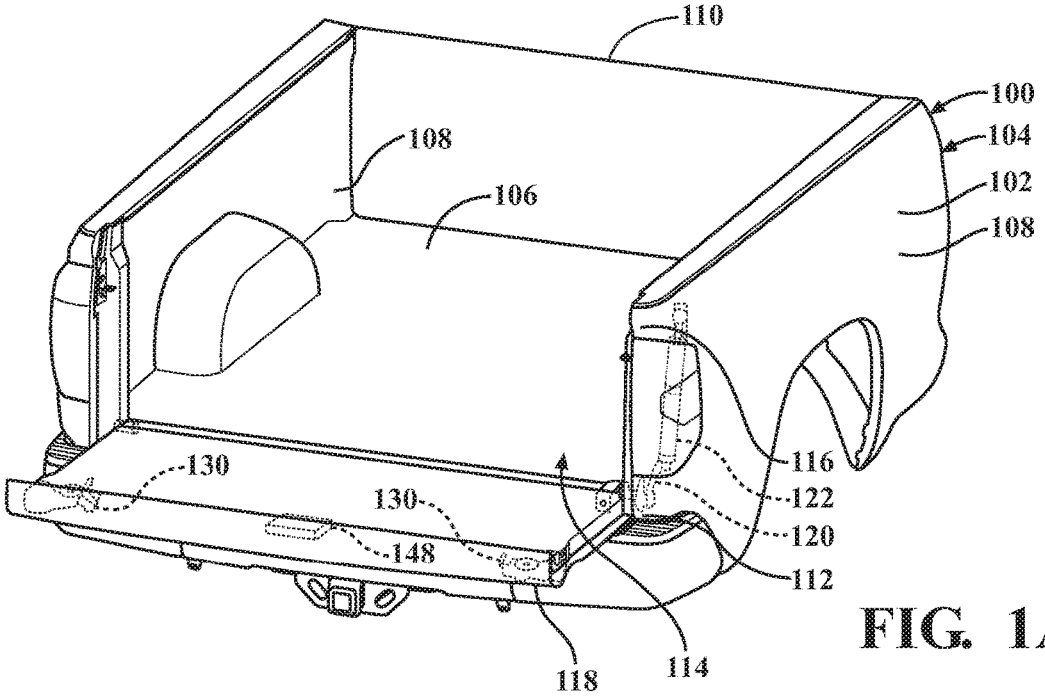
FIGS. 1A, 1B, 1C and 1D portray a vehicle using partial perspective views and a block diagram, showing a bed, a tailgate, tailgate-side latch assemblies that include latches for latching the tailgate, vehicle-side strikers for the latches, and a power tailgate system that includes a tailgate actuator for the tailgate, latch actuators for the latch assemblies, and, as part of the tailgate actuator, a motor, and a motor circuit for the motor.

Part of a representative passenger vehicle 100 is shown in FIG. 1A. As shown, the vehicle 100 is a pickup truck. The vehicle 100 includes an exterior and a number of interior compartments. In the illustrated pickup truck configuration of the vehicle 100, the compartments include an open-topped bed 102 for carrying cargo. In addition to the bed 102, the compartments may include a passenger compartment, an engine compartment and the like. Among other things, the vehicle 100 may include seats, a dash assembly, an instrument panel and the like housed in the passenger compartment. In addition, the vehicle 100 may include an engine, a motor, a transmission and the like, as well as other powertrain components, such as wheels, housed in the engine compartment and elsewhere in the vehicle 100. The wheels support the remainder of the vehicle 100 on the ground. One, some or all of the wheels are powered by the remainder of the powertrain components to drive the vehicle 100 along the ground.

The vehicle 100 includes a body 104 that forms the exterior and defines or otherwise encloses the bed 102 and the other compartments. In relation to the bed 102, the body 104 includes a deck 106, two sides 108, a bulkhead 110 and a rear end 112. At the rear end 112, the body 104 defines a tailgate opening 114. Likewise, the body 104, including but not limited to the sides 108, renders surrounding body 116 that frames the tailgate opening 114. The tailgate opening 114 opens between the bed 102 and the exterior. Relatedly, as part of the rear end 112, the body 104 includes a tailgate 118 corresponding to the tailgate opening 114.

Figure 1B:
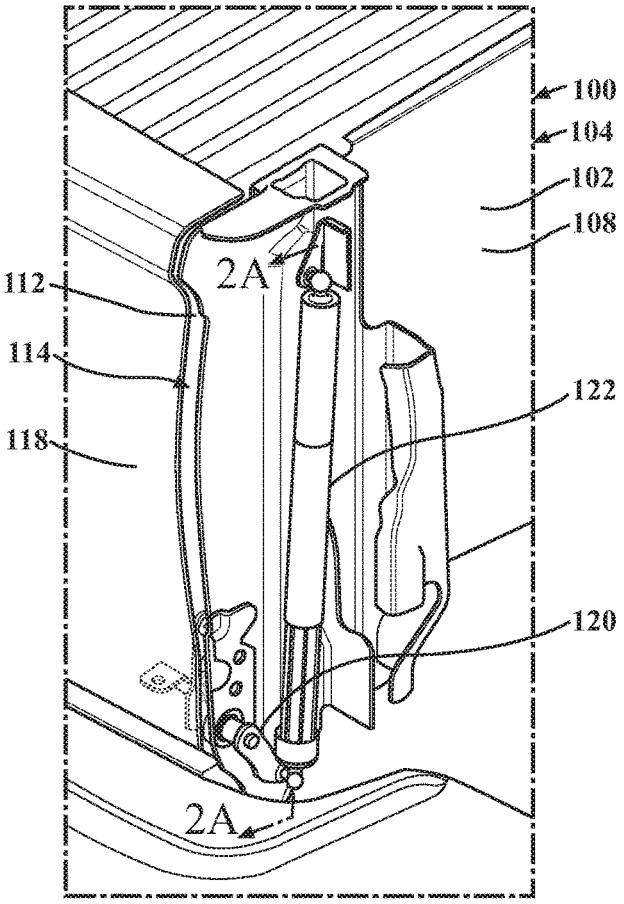
Figure 1C:
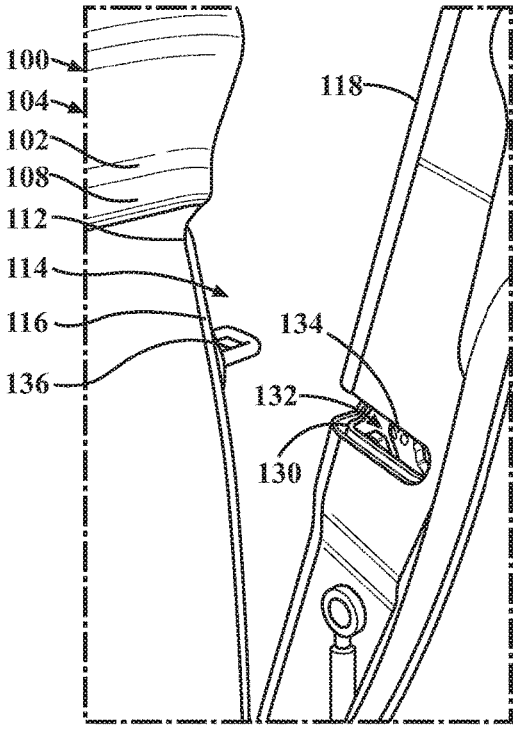

As shown with additional reference to FIGS. 1B and 1C, the tailgate 118 serves as a closure panel for the bed 102. The tailgate 118 is pivotally connected to the surrounding body 116 for movement, relative to the tailgate opening 114, between a closed (or "up") position and an open (or "down") position through a range of partially-open positions. In FIG. 1B, the tailgate 118 is shown in the closed position. In the closed position, the tailgate 118 is positioned over the tailgate opening 114, with the periphery of the tailgate 118 adjacent to the surrounding body 116, and the tailgate 118 in alignment with the surrounding body 116. In FIG. 1A, the tailgate 118 is shown in the open position. In the open position, the tailgate 118 is positioned away from the tailgate opening 114, which allows access to the bed 102 from the rear of the vehicle 100. In FIG. 1C, the tailgate 118 is shown in a representative partially-open position. In the partially-open positions, the tailgate 118 is between the closed position and the open position.

As shown with particular reference to FIG. 1B, in relation to opening the tailgate 118 and closing the tailgate 118, the vehicle 100 includes a hinge assembly 120, and an in-bed tailgate actuator 122. Serving, at least in part, as a basic hinge, the hinge assembly 120 runs between the bed 102 and the tailgate 118. The hinge assembly 120 connects the tailgate 118 to the bed 102, and supports the tailgate 118 from the bed 102 for movement between the closed position and the open position. The tailgate actuator 122 corresponds to the hinge assembly 120, and may be housed, in whole or in part, in the bed 102. From inside the bed 102, the tailgate actuator 122 is connected with the tailgate 118 through the hinge assembly 120. Although the vehicle 100, as shown, includes one hinge assembly 120, and one tailgate actuator 122, it will be understood that this disclosure is applicable in principle to otherwise similar vehicles including one or more hinge assemblies 120, and one or more tailgate actuators 122.

Moreover, as shown with particular reference to FIG. 1C, the vehicle 100 includes one or more tailgate-side latch assemblies 130. Each latch assembly 130 includes a striker chute 132, and a corresponding latch 134 for latching the tailgate 118. Relatedly, the vehicle 100 includes one or more vehicle-side strikers 136 corresponding to the striker chutes 132 and the latches 134. Each latch assembly 130 is connected to the tailgate 118. Each latch assembly 130 may be housed, in whole or in part, in the tailgate 118. For instance, each latch assembly 130 may be housed in the tailgate 118, and connected to the tailgate 118, as a unitary module. Each striker 136 is connected to the surrounding body 116. Although the vehicle 100, as shown, includes two latch assemblies 130 and two strikers 136, it will be understood that this disclosure is applicable in principle to otherwise similar vehicles including one or more latch assemblies 130 and one or more strikers 136.

For each corresponding striker chute 132, latch 134 and striker 136, the striker chute 132 opens to the tailgate 118 for passing the striker 136 into and out of the tailgate 118. The latch 134 is movable, relative to the striker chute 132, in a latching direction and in an unlatching direction between an unlatching position and a latching position. In FIG. 1C, the latch 134 is shown in the unlatching position. In the unlatching position, the latch 134 aligns with the striker chute 132 for passing the striker 136 into and out of the tailgate 118. In the latching position, the latch 134 crosses the striker chute 132 for capturing the striker 136 within the tailgate 118. Accordingly, the latch 134 latches the tailgate 118 to the surrounding body 116 against the striker 136.

The latch 134 may be activated for non-revertible movement in the latching direction. When the tailgate 118 is being closed, the latch 134 functions as the tailgate 118 is moved to the closed position, and afterward, when the tailgate 118 is in the closed position. With the tailgate 118 in the open position, the latch 134, having previously unlatched the tailgate 118, is in the unlatching position. To close the tailgate 118, the latch 134 is activated for non-revertible movement in the latching direction. As the tailgate 118 is moved to the closed position, the striker 136 passes into the tailgate 118 through the striker chute 132. As it passes into the tailgate 118, the striker 136 moves the latch 134 in the latching direction to the latching position, and the latch 134, unable to move in the unlatching direction to the unlatching position, latches the tailgate 118 to the surrounding body 116 against the striker 136.

In addition, the latch 134 may be deactivated for movement in the unlatching direction. When the tailgate 118 is being opened, the latch 134 functions as the tailgate 118 is moved to the open position. With the tailgate 118 in the closed position, the latch 134, having previously latched the tailgate 118, is in the latching position. To open the tailgate 118, the latch 134 is deactivated for movement in the unlatching direction. As the tailgate 118 is moved to the open position, the striker 136 passes out of the tailgate 118 through the striker chute 132. As it passes out of the tailgate 118, the striker 136, in combination with a bias for movement in the unlatching direction, moves the latch 134 in the unlatching direction to the unlatching position, and the latch 134 unlatches the tailgate 118 from the surrounding body 116 from against the striker 136.

Figure 1D:
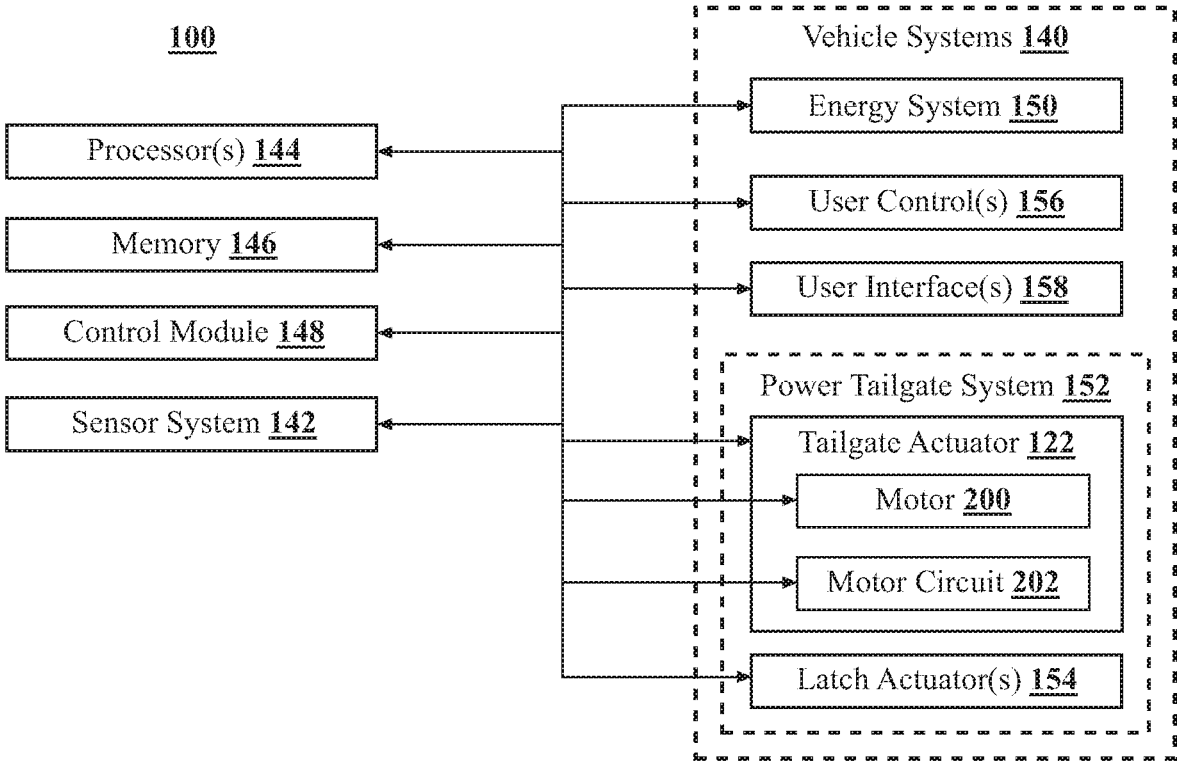

As shown with additional reference to FIG. 1D, the vehicle 100 includes one or more vehicle systems 140 operable to perform vehicle functions. In addition to the vehicle systems 140, the vehicle 100 includes a sensor system 142, as well as one or more processors 144, memory 146, and a control module 148 to which the vehicle systems 140 and the sensor system 142 are communicatively connected. The control module 148 may be housed, in whole or in part, in the tailgate 118. The sensor system 142 is operable to detect information about the vehicle 100. The processors 144, the memory 146 and the control module 148 together serve as a computing device whose control module 148 is employable to orchestrate the operation of the vehicle 100, in whole or in part. Specifically, the control module 148 operates the vehicle systems 140 based on information about the vehicle 100. Accordingly, as a prerequisite to operating the vehicle systems 140, the control module 148 gathers information about the vehicle 100, including the information about the vehicle 100 detected by the sensor system 142. The control module 148 then evaluates the information about the vehicle 100, and operates the vehicle systems 140 based on its evaluation.

The vehicle systems 140 are part of, mounted to or otherwise supported by the body 104. Each vehicle system 140 includes one or more vehicle elements. On behalf of the vehicle system 140 to which it belongs, each vehicle element is operable to perform, in whole or in part, any combination of vehicle functions with which the vehicle system 140 is associated. It will be understood that the vehicle elements, as well as the vehicle systems 140 to which they belong, may but need not be mutually distinct.

The vehicle systems 140 include an energy system 150 and a power tailgate system 152. The power tailgate system 152 is connected to the energy system 150. Moreover, the power tailgate system 152 is connected to the tailgate 118, and to the latch assemblies 130. The energy system 150 is operable to perform one or more energy functions, including but not limited to storing and otherwise handling electrical energy. The power tailgate system 152 is operable to perform one or more power tailgate functions using electrical energy from the energy system 150, including but not limited to automatically opening the tailgate 118, automatically closing the tailgate 118, and checking the tailgate 118 against movement.

Among the power tailgate elements of the power tailgate system 152, the vehicle 100 includes the tailgate actuator 122. The tailgate actuator 122 is connected to the energy system 150. Moreover, the tailgate actuator 122 is connected with the tailgate 118 through the hinge assembly 120. Through the hinge assembly 120, the tailgate actuator 122 is operable to open the tailgate 118, close the tailgate 118 and otherwise move the tailgate 118 between the closed position and the open position using electrical energy from the energy system 150. Although the vehicle 100, as shown, includes one tailgate actuator 122 in the power tailgate system 152, it will be understood that this disclosure is applicable in principle to otherwise similar vehicles including one or more tailgate actuators 122 in the power tailgate system 152.

Also among the power tailgate elements of the power tailgate system 152, the vehicle 100 includes one or more latch actuators 154 for the latch assemblies 130. Each latch actuator 154 corresponds to a latch assembly 130, and may be housed, in whole or in part, in the tailgate 118. For instance, each latch actuator 154 may be housed in the tailgate 118, and connected to the tailgate 118, as a unitary module with the corresponding latch assembly 130. In one implementation, each latch actuator 154 is a motor-driven reduction drive. In this and other implementations, each latch actuator 154 is connected to the energy system 150. Moreover, each latch actuator 154 is connected with the corresponding latch assembly 130. For each corresponding latch assembly 130, latch 134 and latch actuator 154, using electrical energy from the energy system 150, the latch actuator 154 is operable to activate the latch 134 for non-revertible movement in the latching direction, and deactivate the latch 134 for movement in the unlatching direction. Although the vehicle 100, as shown, includes one latch actuator 154 per latch assembly 130 in the power tailgate system 152, it will be understood that this disclosure is applicable in principle to otherwise similar vehicles including one or more latch actuators 154 per latch assembly 130 in the power tailgate system 152.

The vehicle 100 includes one or more user controls 156 and one or more user interfaces 158 for the power tailgate system 152. In the vehicle 100, the user controls 156 and the user interfaces 158 may be part of an infotainment system typical of vehicles, or dedicated to the power tailgate system 152. The user controls 156 serve as interfaces between users and the vehicle 100 itself, and are operable to receive mechanical, verbal and other user inputs for generating requests. Similarly, the user interfaces 158 serve as interfaces between users and the vehicle 100 itself, and are operable to issue tactile, sound and visual outputs that may be sensed by users. For instance, the vehicle 100 may include one or more onboard or off-board user controls 156 for remotely generating requests to automatically open the tailgate 118 from in the passenger compartment or otherwise away from the tailgate 118. For instance, the vehicle 100 may include one or more onboard or off-board user controls 156 for non-remotely generating requests to automatically open the tailgate 118 from the rear of the vehicle 100 or otherwise adjacent the tailgate 118.

As part of the sensor system 142, the vehicle 100 includes one or more onboard sensors. The sensors monitor the vehicle 100 in real-time. The sensors, on behalf of the sensor system 142, are operable to detect information about the vehicle 100, including information about the operation of the vehicle 100. Among the sensors, the vehicle 100 includes one or more tailgate sensors, one or more latch sensors, one or more controller area network (CAN) sensors and the like. Relatedly, among information about the operation of the vehicle 100, the sensor system 142 is operable to detect the driving conditions of the vehicle 100, the movement of the tailgate 118, the movement of the latches 134, requests to automatically open the tailgate 118, requests to automatically close the tailgate 118, and the operational statuses of one, some or all of the vehicle systems 140, including the energy system 150, the tailgate actuator 122 and the latch actuators 154.

Figure 2A:
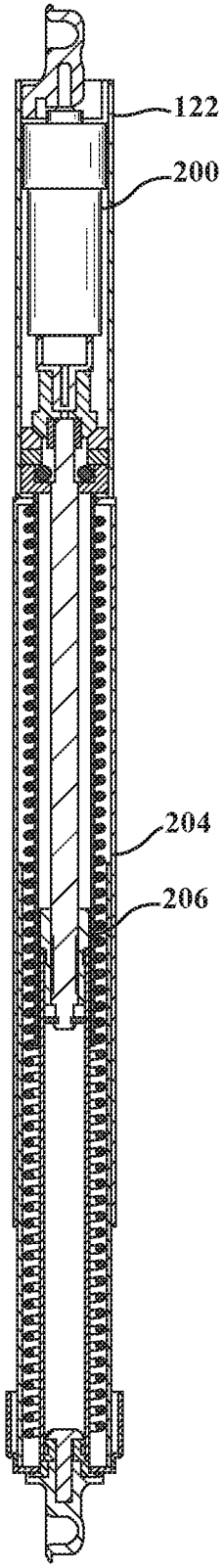
FIG. 2A portrays the tailgate actuator using a cross-sectional view taken along the line 2A-2A in FIG. 1B, showing the motor included as part of the tailgate actuator in an implementation in which the tailgate actuator is a motor-driven spindle drive.
Figure 2B:
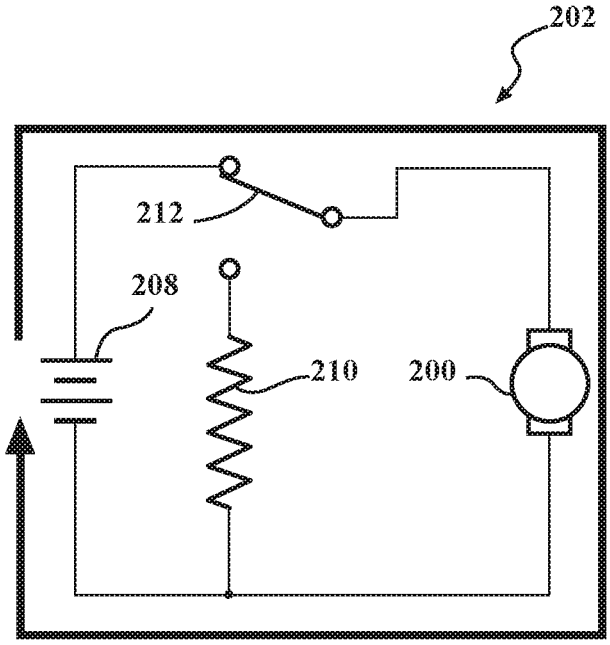
FIGS. 2B and 2C portray the motor circuit using circuit diagrams, showing aspects of operating the motor circuit to electrically brake the motor.
Figure 2C:
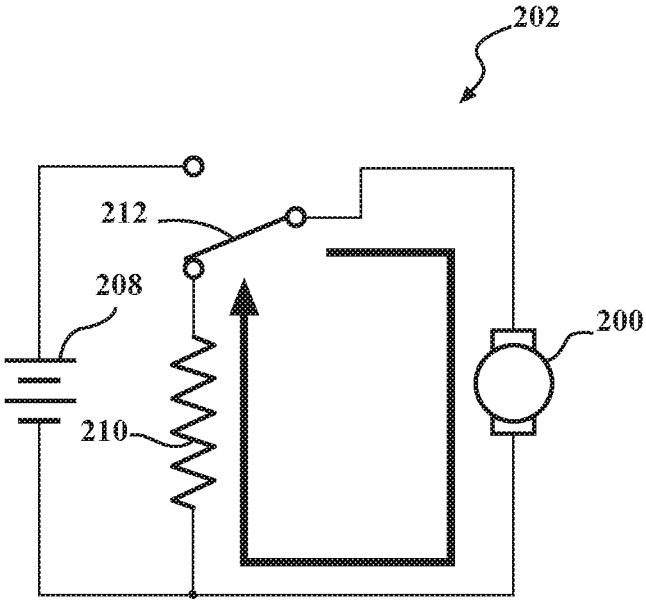

As shown with additional reference to FIGS. 2A-2C, among the power tailgate elements of the power tailgate system 152, as part of the tailgate actuator 122, the vehicle 100 includes a motor 200, and a motor circuit 202 for the motor 200.

As shown with particular reference to FIG. 2A, in one implementation, the tailgate actuator 122 is a motor-driven spindle drive. As part of the tailgate actuator 122, the motor 200 is connected with the tailgate 118 for interdependent movement. In particular, the tailgate actuator 122 includes a two-piece telescoping or otherwise extensible housing 204. Inside the housing 204, the tailgate actuator 122 includes axially aligned items for converting rotary movement into linear extension and retraction, including the motor 200, and a screw and nut assembly 206. In one implementation, the screw and nut assembly 206 may include a ball screw and a ball nut. The motor 200 is operable to spin, and, as the product of spinning, drive the tailgate actuator 122 to extend and retract. In particular, the motor 200 is operable to spin, and thereby drive the screw and nut assembly 206. As the screw and nut assembly 206 is driven, the housing 204 is alternately drawn apart and drawn together. As the housing 204 is drawn apart, the tailgate actuator 122 is extended. Alternately, as the housing 204 is drawn together, the tailgate actuator 122 is retracted. As it extends and retracts, the tailgate actuator 122 opens the tailgate 118, closes the tailgate 118 and otherwise moves the tailgate 118 between the closed position and the open position through the hinge assembly 120.

Among other things, it follows that the motor 200 is connected with the tailgate 118 for interdependent movement through the remainder of the tailgate actuator 122, including the housing 204 and the screw and nut assembly 206, and the hinge assembly 120. Likewise, as the product of spinning, and thereby driving the tailgate actuator 122, the motor 200 is operable to open the tailgate 118, close the tailgate 118 and otherwise move the tailgate 118 between the closed position and the open position. Equally, as the product of opening, closing and otherwise moving between the closed position and the open position, the tailgate 118 drives the tailgate actuator 122, and, as it drives the tailgate actuator 122, spins the motor 200.

As shown with particular reference to FIGS. 2B and 2C, in addition to the motor 200, the motor circuit 202 includes a voltage source 208 for the motor 200, a braking resistor 210 for the motor 200, and a switch 212 for alternatively applying electrical items across (i.e., across the terminals of) the motor 200. As the product of operating the switch 212, the motor circuit 202 is operable to apply the voltage source 208 across the motor 200, as shown in FIG. 2B. Likewise, with the voltage source 208 applied across the motor 200, the motor circuit 202 is operable to electrically energize the motor 200 for spinning action using voltage from the voltage source 208. Moreover, the motor circuit 202 is operable to apply a closed circuit across the motor 200, as shown in FIG. 2C. As shown, the motor circuit 202 is operable to apply the braking resistor 210 across the motor 200. Alternatively, the motor circuit 202 may be similarly operable to apply a short circuit across the motor 200. As the product of applying the braking resistor 210, a short circuit or like closed circuit across the motor 200, the motor circuit 202 is operable to electrically brake the motor 200, whereupon the motor 200 resists being mechanically driven for spinning action. Likewise, with the motor 200 connected with the tailgate 118 for interdependent movement, as the product of electrically braking the motor 200, the motor circuit 202 is operable to check the tailgate 118 against movement.

Figure 3:
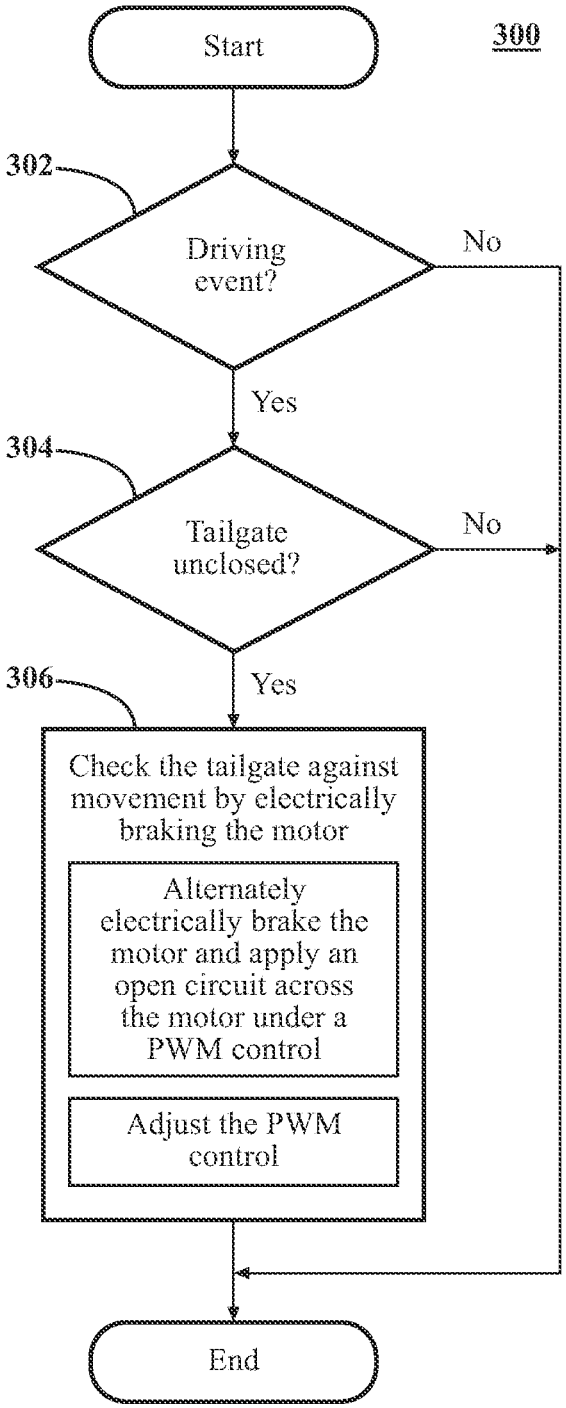
FIG. 3 portrays the operations of a process for operating the power tailgate system using a flow chart, showing aspects of checking the tailgate against movement when, upon the initiation of driving events, the tailgate is unclosed.

The operations of a process 300 for operating the power tailgate system 152 are shown in FIG. 3. According to the process 300, when, upon the initiation of driving events, the tailgate 118 is unclosed, the power tailgate system 152 checks the tailgate 118 against movement by electrically braking the motor 200. Although the process 300 is described with reference to one tailgate actuator 122, including, as part of the tailgate actuator 122, one motor 200, and one motor circuit 202, and one latch actuator 154 and corresponding latch assembly 130 and latch 134, it will be understood that this disclosure is applicable in principle to otherwise similar processes for one or more tailgate actuators 122, one or more motors 200, one or more motor circuits 202, one or more latch actuators 154, one or more latch assemblies 130 and one or more latches 134.

According to the process 300, the control module 148 gathers information about the vehicle 100 for evaluation, including the driving conditions of the vehicle 100, the movement of the tailgate 118, the movement of the motor 200, the movement of the latch 134, and other information about the vehicle 100 detected by the sensor system 142. For instance, with respect to the driving conditions of the vehicle 100, the control module 148 monitors for and identifies driving events indicating the vehicle 100 evidently or prospectively driving along the ground. Moreover, the control module 148 monitors for and identifies driving conditions, including the vehicle 100 evidently or prospectively driving along rough ground, accelerating, decelerating, vibrating, etc. For instance, with respect to any combination of the movement of the tailgate 118 and the movement of the motor 200, the control module 148 monitors for and identifies closed events, open events and partially-open events respectively indicating movement of the tailgate 118 to the closed position, to the open position and to a partially-open position. Moreover, the control module 148 monitors for and identifies movement events indicating movement of the tailgate 118 between the closed position and the open position. For instance, with respect to the movement of the latch 134, the control module 148 monitors for and identifies latching events and unlatching events respectively indicating movement of the latch 134 to the latching position and to the unlatching position.

In operation 302, as part of its evaluation of the information about the vehicle 100, the control module 148 monitors for and identifies a driving event. When the control module 148 does not identify a driving event, it continues to monitor for driving events in anticipation that a driving event will materialize.

In operation 304, also as part of its evaluation of the information about the vehicle 100, upon the initiation of the driving event, the control module 148 identifies whether the tailgate 118 is in the closed position, or in the open position, in a partially-open position, or otherwise unclosed. For instance, the control module 148 may identify that the tailgate 118 is in the closed position based on any combination of a closed event and a latching event. For instance, the control module 148 may identify that the tailgate 118 is unclosed based on any combination of an open event, a partially-open event and an unlatching event. The control module 148 may identify that the tailgate 118 is, in particular, in the open position based on an open event. Likewise, the control module 148 may identify that the tailgate 118 is, in particular, in a partially-open position based on a partially-open event.

When the tailgate 118 is in the closed position, the control module 148 jumps to the end of the process 300, and does not check the tailgate 118 against movement during the driving event. For instance, it may be assumed that the latches 134, by latching the tailgate 118, hold it fast against movement.

Otherwise, when the tailgate 118 is unclosed, in operation 306, in response to identifying that the tailgate 118 is unclosed, the control module 148 checks the tailgate 118 against movement during the driving event. For instance, it may be assumed that the latches 134, by unlatching the tailgate 118, no longer hold it fast against movement. Moreover, it may be assumed that, if the tailgate 118 is left unchecked against movement, the movement of the tailgate 118 might become excessive. For instance, when the vehicle 100 drives along rough ground, the movement of the tailgate 118 might become excessive in terms of bouncing. Even when the vehicle 100 drives along normal ground, the movement of the tailgate 118 might become excessive in terms of jolts (e.g., when the vehicle 100 accelerates and decelerates) and vibration (e.g., when the vehicle 100 itself vibrates). By checking the tailgate 118 against movement during the driving event, the control module 148 saves the vehicle 100 from suffering the associated threat of damage.

According to operation 306, the control module 148 checks the tailgate 118 against movement by operating the motor circuit 202 to electrically brake the motor 200. To electrically brake the motor 200, the control module 148 may operate the motor circuit 202 to apply a closed circuit across the motor 200. For instance, the control module 148 may operate the motor circuit 202 to apply the braking resistor 210 across the motor 200. For instance, the control module 148 may operate the motor circuit 202 to apply a short circuit across the motor 200.

With respect to checking the tailgate 118 against movement during the driving event according to operation 306, the control module 148 continuously checks the tailgate 118 against movement for the duration of the driving event. With respect to checking the tailgate 118 against movement according to operation 306, the control module 148 may fully check the tailgate 118 against movement by operating the motor circuit 202 to continuously electrically brake the motor 200. Alternatively, the control module 148 may partially check the tailgate 118 against movement by operating the motor circuit 202 to alternately electrically brake the motor 200 and apply an open circuit across the motor 200 under a pulse width modulation (PWM) control. For instance, the control module 148 may adjust the PWM control to balance electrically braking the motor 200 and applying an open circuit across the motor 200. To increasingly check the tailgate 118 against movement, the control module 148 may adjust the PWM control to increasingly favor electrically braking the motor 200. To decreasingly check the tailgate 118 against movement, the control module 148 may adjust the PWM control to increasingly favor applying an open circuit across the motor 200.

For instance, as part of its evaluation of the information about the vehicle 100, the control module 148 may identify whether or not driving conditions are associated with the movement of the tailgate 118 becoming excessive. For instance, the control module 148 may identify that driving conditions are associated with the movement of the tailgate 118 becoming excessive in association with the vehicle 100 evidently or prospectively driving along rough ground, accelerating, decelerating, vibrating, etc., and otherwise identify that driving conditions are not associated with the movement of the tailgate 118 becoming excessive. For instance, the control module 148 may default to fully checking the tailgate 118 against movement, and switch to partially checking the tailgate 118 against movement when driving conditions are not associated with the movement of the tailgate 118 becoming excessive. Likewise, when driving conditions are thereafter associated with the movement of the tailgate 118 becoming excessive, the control module 148 may switch back to fully checking the tailgate 118 against movement.

For instance, when the control module 148 identifies that the tailgate 118 is in the open position according to operation 304, the control module 148 may fully check the tailgate 118 against movement. For instance, when the control module 148 identifies that the tailgate 118 is in a partially-open position according to operation 304, the control module 148 may partially check the tailgate 118 against movement until it identifies that the tailgate 118 is in the open position, and thereafter fully check the tailgate 118 against movement. For instance, it may be assumed that when the tailgate 118 is in a partially-open position, it is particularly likely that the movement of the tailgate 118 will become excessive. Accordingly, it may be assumed that the tailgate 118 should be temporarily partially checked against movement, and thereby allowed to advance toward the open position with gravity, until it reaches the open position, whereupon the tailgate 118 should remain fully checked against movement.

According to operations 302, 304 and 306, the control module 148 checks the tailgate 118 against movement as a preventative countermeasure against the movement of the tailgate 118 becoming excessive during the driving event. In particular, rather than reacting to the movement of the tailgate 118, the control module 148 checks the tailgate 118 against movement upon the initiation of the driving event, irrespective of whether the tailgate 118 is moving or not moving. Compared to checking the tailgate 118 against movement as a corrective countermeasure against the movement of the tailgate 118 becoming excessive, the control module 148 eliminates issues concerning reaction time.

With reference once again to FIG. 1D, as noted above, the processors 144, the memory 146 and the control module 148 together serve as a computing device whose control module 148 orchestrates the operation of the vehicle 100, including but not limited to the operation of the vehicle systems 140. The control module 148 may be a dedicated control module for the power tailgate system 152, and may be housed, in whole or in part, in the tailgate 118. Relatedly, as part of a central control system, the vehicle 100 may include a global control unit (GCU) to with which the control module 148 is communicatively connected. Alternatively, the control module 148 may be a global control module. Relatedly, as part of a central control system, the vehicle 100 may include a global control unit (GCU) to which the control module 148 belongs. Although the vehicle 100, as shown, includes one control module 148, it will be understood that this disclosure is applicable in principle to otherwise similar vehicles including multiple control modules 148.

The processors 144 may be any components configured to execute any of the processes described herein or any form of instructions to carry out such processes or cause such processes to be performed. The processors 144 may be implemented with one or more general-purpose or special-purpose processors. Examples of suitable processors 144 include microprocessors, microcontrollers, digital signal processors or other forms of circuitry that execute software. Other examples of suitable processors 144 include without limitation central processing units (CPUs), array processors, vector processors, digital signal processors (DSPs), field programmable gate arrays (FPGAs), programmable logic arrays (PLAs), application specific integrated circuits (ASICs), programmable logic circuitry or controllers. The processors 144 may include at least one hardware circuit (e.g., an integrated circuit) configured to carry out instructions contained in program code. In arrangements where there are multiple processors 144, the processors 144 may work independently from each other or in combination with one another.

The memory 146 is a non-transitory computer readable medium. The memory 146 may include volatile or nonvolatile memory, or both. Examples of suitable memory 146 includes random access memory (RAM), flash memory, read only memory (ROM), programmable read only memory (PROM), erasable programmable read only memory (EPROM), electrically erasable programmable read only memory (EEPROM), registers, magnetic disks, optical disks, hard drives or any other suitable storage medium, or any combination of these. The memory 146 includes stored instructions in program code. Such instructions are executable by the processors 144 or the control module 148. The memory 146 may be part of the processors 144 or the control module 148, or may be communicatively connected the processors 144 or the control module 148.

Generally speaking, the control module 148 includes instructions that may be executed by the processors 144. The control module 148 may be implemented as computer readable program code that, when executed by the processors 144, execute one or more of the processes described herein. Such computer readable program code may be stored on the memory 146. The control module 148 may be part of the processors 144, or may be communicatively connected the processors 144.

While recited characteristics and conditions of the invention have been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A system for operating a power tailgate system, comprising:

one or more processors; and a memory communicably coupled to the one or more processors and storing instructions that when executed by the one or more processors cause the one or more processors to:

identify a driving event in a vehicle that includes a tailgate movable between an upward closed position and a downward open position, a motor connected with the tailgate for interdependent movement, and a motor circuit for the motor, the driving event indicating the vehicle driving along the ground;

upon the initiation of the driving event, identify that the tailgate is unclosed; and in response to identifying that the tailgate is unclosed, upon the initiation of the driving event, when the tailgate is moving and when the tailgate is not moving, check the tailgate against movement during the driving event, wherein checking the tailgate against movement includes operating the motor circuit to electrically brake the motor, and wherein checking the tailgate against movement includes partially checking the tailgate against movement when the tailgate is in a partially-open position, and fully checking the tailgate against movement when the tailgate is in the open position.

2. The system of claim 1, wherein electrically braking the motor includes applying a closed circuit across the motor.

3. The system of claim 1, wherein electrically braking the motor includes at least one of applying a braking resistor across the motor, and applying a short circuit across the motor.

4. The system of claim 1, wherein checking the tailgate against movement during the driving event includes continuously checking the tailgate against movement for the duration of the driving event.

5. The system of claim 1, wherein checking the tailgate against movement includes operating the motor circuit to continuously electrically brake the motor.

6. The system of claim 1, wherein checking the tailgate against movement includes operating the motor circuit to alternately electrically brake the motor and apply an open circuit across the motor under a PWM control.

7. The system of claim 6, wherein checking the tailgate against movement includes adjusting the PWM control.

8. A method for operating a power tailgate system, comprising:

identifying a driving event in a vehicle that includes a tailgate movable between an upward closed position and a downward open position, a motor connected with the tailgate for interdependent movement, and a motor circuit for the motor, the driving event indicating the vehicle driving along the ground;

upon the initiation of the driving event, identifying that the tailgate is unclosed; and in response to identifying that the tailgate is unclosed, upon the initiation of the driving event, when the tailgate is moving and when the tailgate is not moving, checking the tailgate against movement during the driving event, wherein checking the tailgate against movement includes operating the motor circuit to electrically brake the motor, and wherein checking the tailgate against movement includes partially checking the tailgate against movement when the tailgate is in a partially-open position, and fully checking the tailgate against movement when the tailgate is in the open position.

9. The method of claim 8, wherein electrically braking the motor includes applying a closed circuit across the motor.

10. The method of claim 8, wherein electrically braking the motor includes at least one of applying a braking resistor across the motor, and applying a short circuit across the motor.

11. The method of claim 8, wherein checking the tailgate against movement during the driving event includes continuously checking the tailgate against movement for the duration of the driving event.

12. The method of claim 8, wherein checking the tailgate against movement includes operating the motor circuit to continuously electrically brake the motor.

13. The method of claim 8, wherein checking the tailgate against movement includes operating the motor circuit to alternately electrically brake the motor and apply an open circuit across the motor under a PWM control.

14. The method of claim 13, wherein checking the tailgate against movement includes adjusting the PWM control.

15. A non-transitory computer-readable medium for operating a power tailgate system including instructions that when executed by one or more processors cause the one or more processors to:

identify a driving event in a vehicle that includes a tailgate movable between an upward closed position and a downward open position, a motor connected with the tailgate for interdependent movement, and a motor circuit for the motor, the driving event indicating the vehicle driving along the ground;

upon the initiation of the driving event, identify that the tailgate is unclosed; and in response to identifying that the tailgate is unclosed, upon the initiation of the driving event, when the tailgate is moving and when the tailgate is not moving, check the tailgate against movement during the driving event, wherein checking the tailgate against movement includes operating the motor circuit to electrically brake the motor, and wherein checking the tailgate against movement includes partially checking the tailgate against movement when the tailgate is in a partially-open position, and fully checking the tailgate against movement when the tailgate is in the open position.

16. The non-transitory computer-readable medium of claim 15, wherein electrically braking the motor includes applying a closed circuit across the motor.

17. The non-transitory computer-readable medium of claim 15, wherein electrically braking the motor includes at least one of applying a braking resistor across the motor, and applying a short circuit across the motor.

18. The non-transitory computer-readable medium of claim 15, wherein checking the tailgate against movement during the driving event includes continuously checking the tailgate against movement for the duration of the driving event.

19. The non-transitory computer-readable medium of claim 15, wherein checking the tailgate against movement includes operating the motor circuit to continuously electrically brake the motor.

20. The non-transitory computer-readable medium of claim 15, wherein checking the tailgate against movement includes operating the motor circuit to alternately electrically brake the motor and apply an open circuit across the motor under a PWM control.

21. The non-transitory computer-readable medium of claim 20, wherein checking the tailgate against movement includes adjusting the PWM control.

* * * * *